United States Patent [19]

Satee

[11] 4,196,061

[45] Apr. 1, 1980

[54] DIRECT NICKEL-PLATING OF ALUMINUM

[75] Inventor: Raichur Satee, Schaumburg, Ill.

[73] Assignee: Chemray Corporation, Westchester, Ill.

[21] Appl. No.: 935,113

[22] Filed: Aug. 21, 1978

[51] Int. Cl.[2] ..... C25D 5/34; C25D 5/44

[52] U.S. Cl. ..... 204/33; 106/1.11; 106/1.27; 204/38 B

[58] Field of Search ..... 204/33, 38 B; 106/1.11, 106/1.27

[56] References Cited

U.S. PATENT DOCUMENTS

| | | | |
|---|---|---|---|
| 2,233,410 | 3/1941 | Frasch | 204/33 |
| 3,284,323 | 11/1966 | Lecoup | 204/33 |
| 3,515,650 | 6/1970 | Asada | 204/33 |
| 3,672,964 | 6/1972 | Bellis | 204/33 |

*Primary Examiner*—T. M. Tufariello

*Attorney, Agent, or Firm*—Michael G. Berkman

[57] ABSTRACT

A process for the deposition of a nickel coating directly on articles of aluminum or aluminum alloys, without need to preplate with an intermediate layer. After immersing the cleaned aluminum article for about one minute at room temperature in an activating solution containing a nickel, cobalt or chromium salt, a cyanide, and ammonium hydroxide to condition and prepare the metal surface, the article is transferred to an electrolytic bath and the article is plated with nickel by electrolytic action. If desired, a chromium coating may then be superimposed on the nickel, using conventional procedures.

8 Claims, No Drawings

DIRECT NICKEL-PLATING OF ALUMINUM

BACKGROUND OF THE INVENTION

This invention relates generally to the deposition of a nickel coating on aluminum and aluminum alloys. More particularly, the invention is directed to an improved process rendering feasible the deposition of nickel directly on aluminum articles without the need to preplate or otherwise to precoat with an intermediate metal layer such as copper.

The plating of metals on aluminum is a complex and highly developed art. For the most part, when it is desired to nickel coat aluminum, the practice has been first to plate the aluminum with an intermediate layer of copper. The nickel coating is then superimposed on the copper film, after which the object may be further processed by applying an outer chromium coating, if desired.

In other processes the aluminum is first dipped in a cadmium plating bath, after which the article is electroplated or otherwise coated with such metals as copper, nickel, tin, or any of other various metals, as desired. In other processing techniques known as the zincate process and the stannate process, a thin coating of zinc or tin is applied to the aluminum prior to the subsequent electrolytic deposition of other coating metals. But these processes always require a copper or a bronze strike to prevent dissolution of the zinc or tin in the nickel bath.

The prior art has recognized the desirability of being able to apply a nickel coating directly to the aluminum substrate, and various compositions and processing procedures have been suggested as a means toward this end. In spite of the long recognized need, and notwithstanding the extensive research and development in the relevant art, no completely satisfactory process has, heretofore, been devised for applying a nickel coating to an aluminum substrate, without the need first to preplate with an intermediate film such as copper. The present invention, therefore, is directed to and has for one of its objects, the provision of an improved process for plating nickel directly on articles of aluminum and aluminum alloys.

SUMMARY OF THE INVENTION

The present invention relates to a process for depositing a film or coating of nickel directly on articles of aluminum or aluminum alloys, without the need to preplate or otherwise to coat with an intermediate layer such as copper, zinc or cadmium. It will be appreciated that an effective, simple process for the direct nickel plating of aluminum is a valuable contribution to the relevant art.

It is an important feature of the invention that the process devised is extremely simple, requiring no processing equipment other than what is ordinarily used in carrying out conventional electrolytic processes.

A related feature of the invention is that the aluminum or aluminum alloys to be processed are easily readied for plating using the conventional prewashing or pre-etching solutions and procedures known in the art.

The treating compositions of the invention are characterized by unusual chemical stability and long useful life.

A related feature of the invention is that it is necessary only to rinse the precleaned articles well with water prior to immersion in the treating composition which constitutes the preferred formulation of the invention.

Yet another feature of the invention is that, when nickel is the only metal (other than aluminum) introduced into the plating tank, the plating bath is effectively protected from contamination.

A related advantage of the process of the invention is that the need for a "strike bath" is obviated, there being only nickel as the metal constituent in the plating system.

It is a feature of the invention that the aluminum articles prepared in accordance with the process devised may be plated using standard techniques or baths and that the final plated layer may be dull, semi-bright, or bright, as preferred for any particular application.

Still another feature of the process of the invention is that the products produced thereby may be conveniently further plated with chromium or other metals, using conventional procedures.

For certain applications, or if preferred, the aluminum articles may be preplated with copper.

DESCRIPTION OF THE PREFERRED EMBODIMENTS

The process of the present invention is highly effective and produces products of excellent quality, with significant savings in materials, time, and manufacturing costs. It is carried out in a series of simple steps. The essence of the invention is believed to lie in a critical combination of chemical agents constituting components of a preplating bath in which the aluminum articles to be plated are initially immersed. The precise mechanism by which the aluminum articles are rendered specially receptive to an adherent coating of nickel, as a result of pretreatment with the novel composition of the invention, is not completely understood. It is believed, however, that the solution serves to precondition or to activate the aluminum surface while obviating the surface formation of an inert layer or molecular interface of aluminum oxide, or of a gaseous film. As a result, the metallic nickel is deposited contiguously on the activated aluminum surface so as to achieve an uninterrupted, positive, direct bonding of the plated film to the supporting, surface-activated substrate.

The process of the invention is applicable to and the advantages derived therefrom are realized in the treatment of aluminum articles and articles fabricated of aluminum alloys. Throughout the specification all such articles are contemplated and encompassed in the word "aluminum."

In accordance with the practice of the invention the article to be treated is first cleaned in accordance with any of the established techniques well known in the art, using either alkaline or acid cleaners. Optionally, the surface of the metal may be pre-etched using a sodium hydroxide solution at a temperature of about 140° F. to 150° F.

It will be appreciated that if an alkaline cleaner is used or if the aluminum is etched, then the surface of the aluminum may require desmutting. This may be carried out using any preferred desmutting composition or deoxidizing preparations such as a nitric acid dip, for example a solution of 50% nitric acid, at room temperature. If an acid precleaner is used, it is necessary merely thoroughly to rinse the article with water.

The surface activating composition of the invention is a critical combination of three chemical agents—a metallic salt, a cyanide, and ammonium hydroxide. The metallic salt may be the acetate, tartrate, or citrate of nickel, cobalt, or chromium. Nickel acetate is preferred. Alternatively, nickel cyanide or the cyanides of cobalt or chromium may be used. The concentration of the metallic salt should be in the range of from about 4 ounces to about 6 ounces per gallon of solution. For the nickel acetate, the concentration is preferably from 4.8 to 5.5 ounces per gallon. Chlorides, carbonates and nitrates are not suitable.

The soluble cyanide used in the composition may be potassium, sodium, or barium cyanide. The potassium cyanide, which is preferred, is used in a concentration in the range of from about 0.8 to about 1½ ounces per gallon of solution. The other cyanides are used in a concentration such as to provide a cyanide ion concentration equivalent to that provided by the potassium cyanide.

The concentration of ammonium hydroxide used is that which is equivalent to a solution containing about 2% to 5% of 30% ammonium hydroxide, by volume.

The precleaned aluminum is immersed for a period of about ½ to 2 minutes in the activating solution of the invention, at room temperature. Preferably, the system is agitated somewhat during the immersion period. There is produced a surface coating which varies in color from light brown to gray to black, depending upon the particular composition of the aluminum article. At elevated temperatures, shorter treatment times are used.

After treatment in the activating solution, the metal article is water rinsed. This step is, however, optional and the treated metal may be transferred directly from the activating solution into a nickel plating electrolytic bath.

The plating with nickel may be carried out using any of the standard techniques known in the art. Accordingly, no detailed disclosure of these processes is necessary herein. Depending upon the intended ultimate use of the plated article, the plating conditions may be controlled to produce any desired surface characteristics such as dull, semi-bright, or bright surfaces, all in accordance with techniques which are also well known in the art.

Consistent with the procedures of the prior art, the nickel plated article may then be subjected to further processing, as, for example, plating with chromium. Conventional, well-known processes may be used, when salts other than nickel salts, including cobalt and chromium salts are used in the activating solution. It is preferred that an intermediate strike bath of a nickel salt be used prior to immersion of the treated aluminum article into the nickel plating bath, so as to minimize contamination. The strike bath is, however, optional, and may be skipped if desired.

The process of the invention constitutes a simple yet highly effective method for depositing a nickel coating directly on an aluminum substrate, without any need for an intermediate transition layer or coating such as copper.

While, for purposes of disclosure, specific preferred embodiments of the invention have been described in detail, changes, modifications, and variations may be made without departing from the spirit of the invention, and all such changes, modifications and variations are included within the appended claims.

What is claimed is:

1. A process for forming a coating of nickel directly on aluminum articles and on articles of aluminum alloys, without predeposition of an intermediate layer, said process comprising the steps of activating the surface of precleaned aluminum articles by immersing the articles in a solution containing, in combination, a salt selected from the group consisting of the cyanides of nickel, cobalt and chromium, in a concentration of from about 4 to about 6 ounces of salt per gallon of solution and ammonium hydroxide, in a concentration corresponding to about 2% to about 5% of a 30% ammonium hydroxide solution per gallon of solution, supporting said articles cathodically in an electrolytic bath containing nickel, and plating nickel on the articles by electrolytic action.

2. A process for forming a coating of metal directly on articles of aluminum and aluminum alloy compositions without predeposition of an intermediate metal layer, said process comprising the steps of:

cleaning the articles in an aqueous bath to remove surface contamination, preparing a metal surface activating solution containing, in combination, a metallic salt selected from the group consisting of the acetate, tartrate, and citrate salts of nickel, cobalt and chromium in a concentration of from about 4 to about 6 ounces of metallic salt per gallon of solution, a cyanide selected from the group consisting of the cyanides of potassium, sodium, and barium to provide a concentration of cyanide ion corresponding to the concentration present in a solution containing from about 0.8 to about 1.5 ounces of potassium cyanide per gallon of solution, and ammonium hydroxide in a concentration corresponding to from about 2% to about 5% of a 30% ammonium hydroxide solution per gallon of solution, immersing the precleaned articles in said metal surface activating solution for a period corresponding to from about ½ minute to about 2 minutes at room temperature to condition said articles for plating, connecting said articles cathodically in an electrolytic bath containing nickel, and passing current through said bath to plate nickel on said articles by electrolytic action.

3. The process as set forth in claim 2 and further comprising the step of protecting the electrolytic bath from contamination, said step comprising dipping said aluminum articles in a strike bath of a nickel salt prior to connecting said articles cathodically in the electrolytic bath.

4. The process as set forth in claim 2 and further comprising the step of agitating said activation solution during immersion of said articles therein.

5. The process as set forth in claim 2 and further comprising the step of electrolytically plating a layer of chromium on the nickel-coated aluminum.

6. The process as set forth in claim 2 wherein said metallic salt is nickel acetate.

7. A surface activating solution for the preconditioning of articles of aluminum and aluminum alloys preparatory to plating nickel on surfaces thereof, said activating solution comprising a metallic salt selected from the group consisting of acetates, tartrates and citrate salts of nickel, cobalt and chromium in a concentration of from about 4 to about 6 ounces of metallic salt per gallon of solution, a cyanide selected from the group consisting of the cyanides of potassium, sodium and barium to provide a concentration of cyanide ion corresponding to the concentration present in a solution containing from about 0.8 to about 1.5 ounces of potassium cyanide per gallon of solution, and ammonium hydroxide in a concentration corresponding to from about 2% to about 5% of a 30% ammonium hydroxide solution per gallon of solution.

8. The surface, activating solution as set forth in claim 7 wherein said metallic salt is nickel acetate.

* * * * *

UNITED STATES PATENT OFFICE

CERTIFICATE OF CORRECTION

Patent No. 4,196,061 Dated April 1, 1980

Inventor(s) RAICHUR SATEE

It is certified that error appears in the above-identified patent and that said Letters Patent are hereby corrected as shown below:

Bracketed number 73 (Assignee) should read Chemray Corporation, Westchester, Illinois , a part interest --.

In claim 8, line 1, after "surface" delete -- , --.

Signed and Sealed this

*Twenty-second* Day of *July 1980*

[SEAL]

*Attest:*

SIDNEY A. DIAMOND

*Attesting Officer*

*Commissioner of Patents and Trademarks*